US007934609B2

(12) United States Patent
Alves et al.

(10) Patent No.: US 7,934,609 B2
(45) Date of Patent: May 3, 2011

(54) DEVICE FOR DISTRIBUTING AT LEAST ONE DISPLAYING ACCESSORY ON A GOODS DISPLAY SURFACE

(75) Inventors: Manuel Alves, Tortosendo (PT); Pedro Cunha, Varberg (SE)

(73) Assignee: Joalpe Industria De Expositores, S.A., Tortosendo (PT)

( * ) Notice: Subject to any disclaimer, the term of this patent is extended or adjusted under 35 U.S.C. 154(b) by 582 days.

(21) Appl. No.: 11/813,583

(22) PCT Filed: Jan. 11, 2006

(86) PCT No.: PCT/EP2006/000303

§ 371 (c)(1),
(2), (4) Date: Jul. 1, 2008

(87) PCT Pub. No.: WO2006/074955

PCT Pub. Date: Jul. 20, 2006

(65) Prior Publication Data

US 2008/0296241 A1 Dec. 4, 2008

(30) Foreign Application Priority Data

Jan. 12, 2005 (FR) ..... 05 00307

(51) Int. Cl.
*A47F 1/04* (2006.01)

(52) U.S. Cl. ..... 211/59.2; 211/184

(58) Field of Classification Search ..... 211/59.2, 211/59.4, 184, 43, 90.04; 108/60, 61
See application file for complete search history.

(56) References Cited

U.S. PATENT DOCUMENTS

| | | | | |
|---|---|---|---|---|
| 607,891 | A * | 7/1898 | Smith | 211/184 |
| 3,559,815 | A * | 2/1971 | Huddleston | 211/184 |
| 4,615,276 | A | 10/1986 | Garabedian et al. | |
| 4,830,201 | A * | 5/1989 | Breslow | 211/184 |
| 5,255,802 | A * | 10/1993 | Krinke et al. | 211/184 |
| 5,489,031 | A * | 2/1996 | Carroll | 211/134 |
| 5,655,670 | A * | 8/1997 | Stuart | 211/43 |
| 5,673,801 | A * | 10/1997 | Markson | 211/59.3 |
| 6,006,678 | A * | 12/1999 | Merit et al. | 108/60 |
| 6,533,131 | B2 * | 3/2003 | Bada | 211/59.2 |
| 6,655,536 | B2 * | 12/2003 | Jo et al. | 211/59.3 |
| 2004/0245197 | A1 | 12/2004 | McElvaney | |
| 2010/0066221 | A1 * | 3/2010 | Hakemann | 312/296 |

FOREIGN PATENT DOCUMENTS

| | | |
|---|---|---|
| EP | 1514493 | 3/2005 |
| WO | WO 03/070064 | 1/2003 |
| WO | WO 2004/112549 | 12/2004 |

* cited by examiner

*Primary Examiner* — Korie Chan
(74) *Attorney, Agent, or Firm* — Egbert Law Offices PLLC

(57) ABSTRACT

The invention relates to a device for distributing at least one displaying accessory on a goods display surface, such as a shelf surface, cabinet or the similar. The displaying accessory can be a separating partition or a goods display cabinet formed of a carriage sliding on a tracking path. The device includes at least one first guide fixable to the proximal part of the display surface and extendable over the surface, generally along the longitudinal axis thereof. The first guide interacts with a clamp of the displaying accessory for fixing the accessory to the display surface. The device also includes a holder provided at the level of the first guide and, in the first release position, the holder enables at least one displaying accessory to be moved or even to be released. In a second position, the holder strongly fixes at least one displaying accessory to the first guide.

6 Claims, 6 Drawing Sheets

DEVICE FOR DISTRIBUTING AT LEAST ONE DISPLAYING ACCESSORY ON A GOODS DISPLAY SURFACE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a device for the distribution of at least one presentation accessory at a display surface of goods, such as, in particular, the surface of a shelf, of shelving or the like.

In the field of department stores, it is known to use numerous presentation accessories, and in particular partition walls, or still display packs of articles 2. Description of Related Art Including Information Disclosed Under 37 CFR 1.97 and 37 CFR 1.98

Generally, the articles to be displayed are arranged in rows perpendicular to the greater longitudinal axis of the display surface on a portion of shelf space. The latter may be, in particular, held by means of article display racks, which may take on different shapes, such as aback rest sliding on a running track. There are several types, such as those actuated by means of a pull cord, pushed by a spring, or still fed by gravity action.

Generally, the different articles are separated by means of partition walls in order to hold the same articles on the portion of shelf space allotted thereto. The price tags are then placed usually in front of the articles by means in particular of tag holders.

Today, for the distribution of said partition walls, it is known to arrange two profiled strips, each exhibiting a T-shaped rail, the latter being positioned at the front and at the rear of the display surface of goods. The partition walls then exhibit two jaws capable of gripping at the front rail and the rear rail.

Nevertheless, this process exhibits several shortcomings. First of all, some time after first placement of said walls, the latter have a tendency to move with use, and therefore come out of parallel alignment, marring the overall impression made by the display surface.

Besides, when an operator wishes to re-model the selling surface, and in particular the arrangement of different articles, the positions of said partitions must be modified in relation to in particular the width of the new articles to be displayed.

The operator must then remove the partition walls one by one by disengaging the front and rear jaws from each of said partitions, which renders the operation cumbersome. The operator must, in particular, reach to the end of the shelf. Also, breakage is likely to occur, when dismantling the set.

Besides, when replacing these partitions, the operator must again adjust the position of the partition walls in order to restore the parallel relationship thereof. It should then be understood that this system is not satisfactory, proves a waste of time as well as costly in the long run.

Document WO 2004/112549 discloses a system for fastening accessories on a shelf. The accessory may be a partition wall and exhibits a front foot protruding downwards, intended for engaging into a channel element of the system.

The channel element is received in a front recess of the shelf dedicated to that end and extends longitudinally to the latter. The element exhibits an open channel as well as a control element, joined to the channel. The control element may adopt two positions for blocking or not, the translation of the foot of the accessory being inside the channel.

Document WO 2003/070064 relates to a single-piece profile intended for being fixed to the proximal surface of a shelf. This profile exhibits a rear mounting rail for fastening accessories such as partition walls and a front portion forming a tag holder.

Document US 2004 245197 exhibits a positioning band intended for being fastened to the proximal surface of a shell for guiding and distributing accessories, in particular partition walls.

The positioning band exhibits a formation of a spherical section as well as a finger extending upwards. The accessory, in particular, the separator, exhibits a housing provided for engaging, along an annular link, with the formation, as well as a finger being provided for engaging into the finger of the band and locking the separator thereto.

The aim of the present invention is to provide a device for the distribution of at least one presentation accessory which remedies the shortcomings aforementioned and in particular enables easy and quick arrangement, and possible re-arrangement, of the presentation surfaces.

Another aim of the invention is to provide a device for the distribution of at least one presentation accessory also incorporating the presentation functions of price tags.

Another aim of the invention is to provide a device for the distribution of at least one presentation accessory ensuring the parallelism of the presentation accessories.

Another aim of the invention is to provide a device for the distribution of at least one presentation accessory whereof the placement does not depend on the shape of the support, and in particular the width of the front edge of a shelf, forming said display surface of goods.

Other aims and advantages of the invention will appear in the following description, which is given only by way of example, and without being limited thereto.

BRIEF SUMMARY OF THE INVENTION

The present invention relates to a device for the distribution of at least one presentation accessory at a display surface of goods, such as, in particular, the surface of a shelf, of a shelving or the like. At least one presentation accessory may be, for instance, a partition wall capable of dividing the display surface of goods, or, for instance, a display pack of articles, such as a back rest sliding on a running track. The device exhibits at least a first guiding means capable of being fastened at the proximal section (P) of the display surface (S) and extending in all or in part, globally along the longitudinal axis of the latter. The first guiding means is capable of cooperating with catching means of one presentation accessory in order to slave the latter to said display surface. The device is formed by a base profile, provided for being fastened at the proximal portion of the display surface, joined by a hinge to a second profile with a lever function. The hinge defines the first guiding means and a clamping means, wherein the first guiding means and clamping means consist of two upper projections of the base profile and the second profile. The clamping means may adopt, when raising the second profile, a first, so-called loose position, allowing the displacement of at least one presentation accessory along the greater axis of the display surface (S), possibly even the disengagement thereof. When said second profile is lowered, a second, so-called locking position is adopted, solidly securing at least presentation accessory to said first guiding means. The second profile is a tag supporting profile or still a mother profile for fastening removable tag holders.

BRIEF DESCRIPTION OF THE SEVERAL VIEWS OF THE DRAWINGS

The invention will be understood better when reading the following description accompanied by the appended drawings which are an integral part thereof.

DETAILED DESCRIPTION OF THE INVENTION

Figure 1:
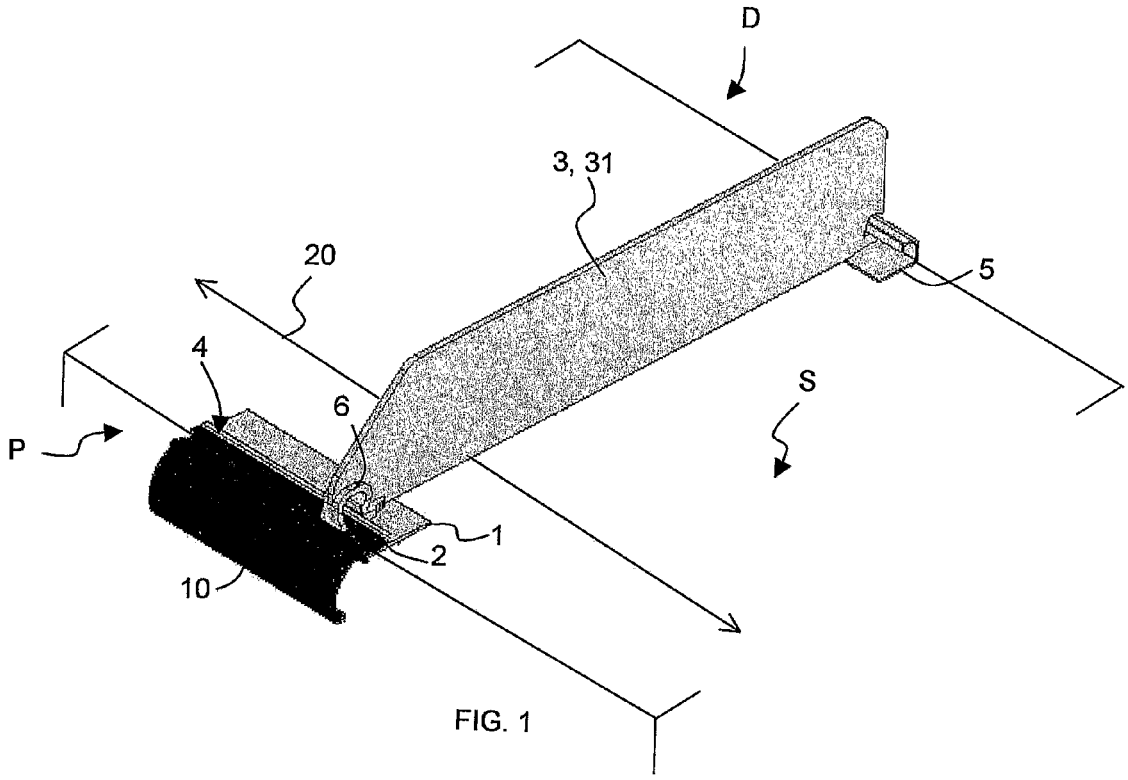
FIG. 1 is a perspective view of a display surface fitted with a device for the distribution of at least one presentation accessory according to the invention.

The invention relates to a device for the distribution of at least one presentation accessory 3 at a display surface of goods S, such as, in particular, the surface of a shelf, of shelving or the like. Said at least one presentation accessory 3 can be for instance, a partition wall 31 capable of dividing said display surface of goods S, or still, for instance, a display rack of articles, such as a back rest sliding on a running track.

Said device exhibits at least first guiding means 2 capable of being fastened at the proximal section P of said display surface S and extending globally, in all or in part, along the longitudinal axis 20 of the latter.

Said first guiding means 2 are capable of co-operating with catching means 6 of one said presentation accessory 3 in order to slave the latter to said display surface S.

According to the invention, the device exhibits clamping means 4, provided at least at said first guiding means 2, which in a first, so-called loose position, allow the displacement of said at least one presentation accessory 3 along said greater axis 20 of the display surface S, possibly even the disengagement thereof. In a second, so-called locking position, said at least one presentation accessory 3 is solidly fixed to said first guiding means 2.

Advantageously, the clamping means 4 may be controlled by maneuvering means formed by a tag supporting profile 11 or by a mother profile 12 for fastening tag holders 14.

According to an embodiment of the invention, the first guiding means 2 form the clamping means 4.

The clamping means 4 extend over the whole length or a portion of the first guiding means 2 and are capable, in a single operation, of locking a plurality of presentation accessories 3 to said first guiding means 2.

Thus, advantageously, an operator may, in a single action, on the clamping means 4, unlock a plurality of presentation accessories 3. The operator may then locate each of said accessories 3 by causing them to slide along the axis 20 of the guiding means 2. The accessories 3 are advantageously secure in their new position in a single locking action on the clamping means 4.

The clamping means 4 are capable, in said second locking position, of urging said at least one presentation accessory 3 in a position substantially perpendicular to said greater longitudinal axis 20.

Advantageously, according to this embodiment, locking the clamping means 4 enables restoration of the parallelism between said presentation accessories 3.

According to an embodiment, the device exhibits second guiding means 5 arranged at the distal section of the display surface S, capable of cooperating with corresponding means 33 of one presentation accessory 3.

Figure 2:
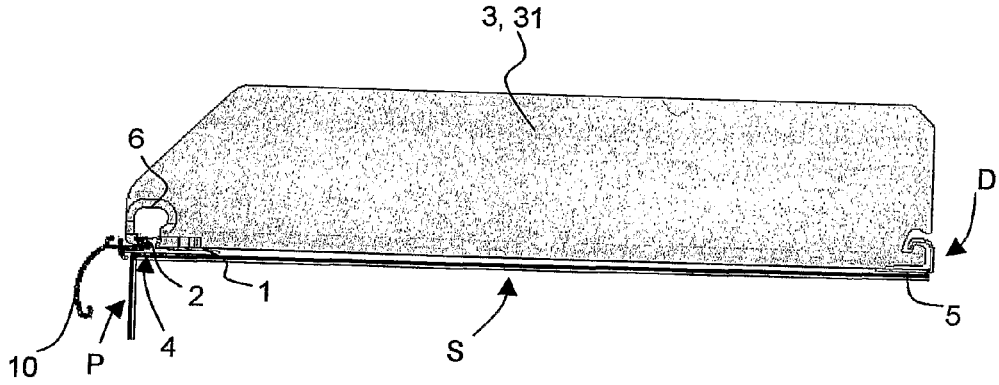
FIG. 2 is a cross-sectional view of the display for the distribution of at least one presentation accessory as illustrated on FIG. 1.
Figure 6:
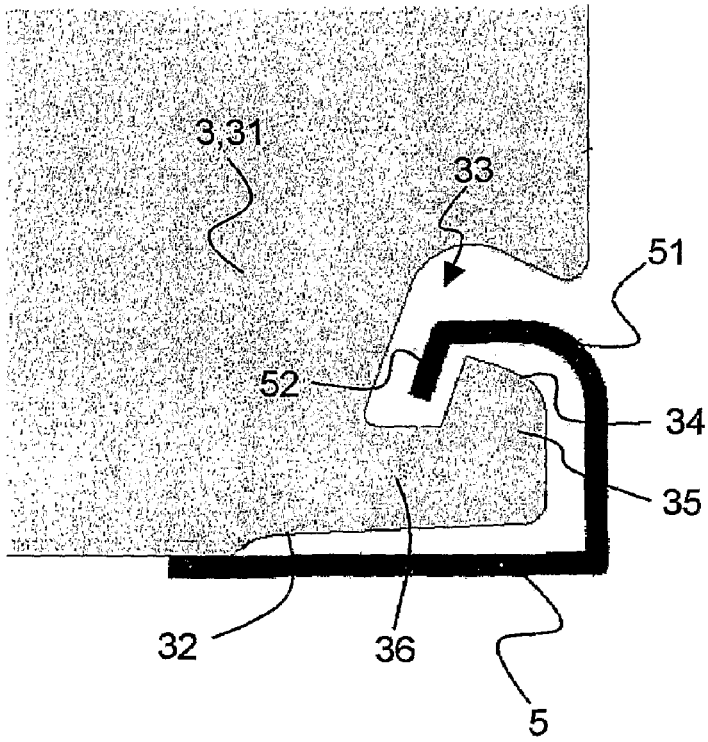
FIG. 6 is a side and detailed sectional view of the device as illustrated on FIG. 2.

As illustrated on FIGS. 1 and 2, and more in detail on FIG. 6, said second guiding means 5 enable loose guiding of said presentation accessories 3, so as to enable, when locking the clamping means 4, the restoration of said presentation accessories 3 in a position substantially perpendicular to said greater presentation axis 20.

Said second guiding means 5 may be formed of a profile fixed to the distal section D of the presentation surface. The latter may be fixed by any means and in particular by means of an adhesive, by means of clips, by means of screws, or still by means of a magnetic system.

As illustrated on FIG. 6, the profile 5 may consist of a base capable of being fastened to the presentation surface from which an inverted-L-shaped profile section 51 rises, including, at the end thereof, a bead 52 forming a step. Advantageously, one said presentation accessory 3, and in particular a partition wall 31, exhibits means 33 for cooperating with this profile 51, 52.

Advantageously, said presentation accessory 3 may exhibit a portion of material 35 capable of cooperating with said profile 51, 52 by resilient deformation of the latter.

The portion of material 35 is capable of cooperating with the step formed of the bead 52 and the portion 51 of the profile of the guiding means 5. The portion of material 35 is linked to said presentation accessory 3 at a portion of material 36 of smaller width. The portion of material 35 exhibits a curved contact ridge 34 which enables deformation of said profile of said second guiding means 5 when being inserted. The portions of material 35 and 36 exhibit, at the lower section thereof, a single ridge 32 which enables guidance of said presentation accessory to straddle the base of the second guiding means 5 when being placed.

The portions of material 35 and 36 may be realized by cutting into the partition wall 31. They may also be realized directly when molding said parts.

Figure 12:
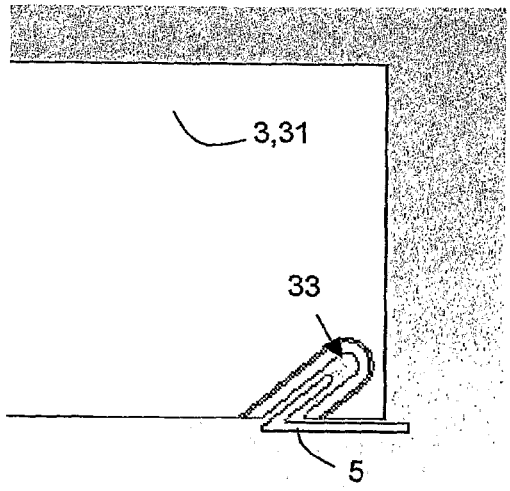
FIG. 12 illustrates on a side sectional view of a second embodiment of the second guiding means.

According to another embodiment illustrated on FIG. 12, the profile 5 exhibits a tilted wing engaging a lower emerging opening of the accessory 3, also tilted and, in particular, at an acute angle.

According to an embodiment, the first guiding means 2 are formed at a base profile 1 arranged on the upper surface of the display surface S.

The base profile 1 will be in the form of a planar stick simply laid and fastened at the upper proximal section of the display surface and may be fastened by any means and in particular by means of screws, an adhesive, or a magnetic system. Thus, advantageously, the base profile 1 may be fixed to any type of shelf or tray and does not depend, in particular, on the fastening portion which may be snapped on the front edge of said shelves.

Figure 3:
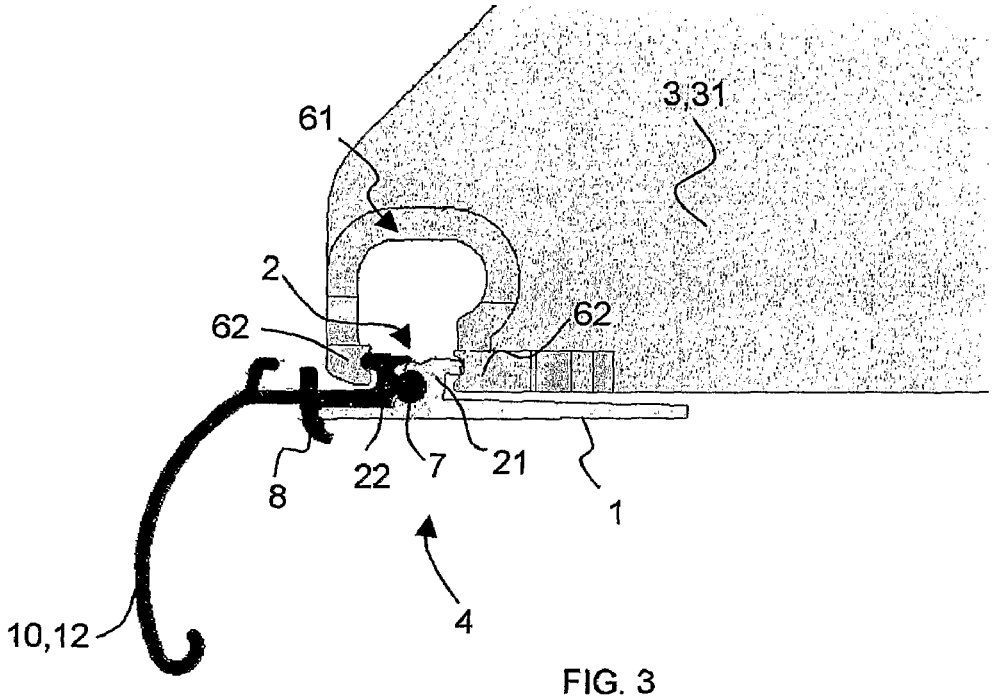
FIG. 3 is a detailed sectional view of the device as illustrated on FIG. 2, the clamping means in a locking position.

As illustrated on FIG. 3, at least one presentation accessory 3 exhibits clamping means 6 formed by at least one elastic jaw 61. The opposed cheeks 62 are capable of meshing into the base profile 1, substantially formed, at least partially, of a T-shaped rail 2.

The clamping means 4 consist of means 7, 21, 22 for decreasing or increasing the size or width of the horizontal wing of said T-shaped rail. Thus, by decreasing the width of the horizontal wing of said T-shaped rail. The loads of the elastic jaw 61 are reduced, and an operator may then move said accessories 3 easily on the axis 20 of the guiding means. Conversely, when the distance from the horizontal wing of the T-shaped rail 2 is increased, the loads of the jaw 61 on the rail increase. A presentation accessory 3 is then fixed solidly to said rail 2 along a position substantially perpendicular to the greater axis 1, and the friction loads then prevent any displacement of said accessories 3 along said first guiding means 2.

Said at least one base profile 1 is hinged to a second profile 10 with a lever function, at a hinge 7, to define the rail 2 and formed of two semi-Ts 21, 22, abutting against one another. One of the semi-Ts 21 is slaved to said base profile 1, the other semi-T 22 being slaved to said second profile 10.

Figure 4:
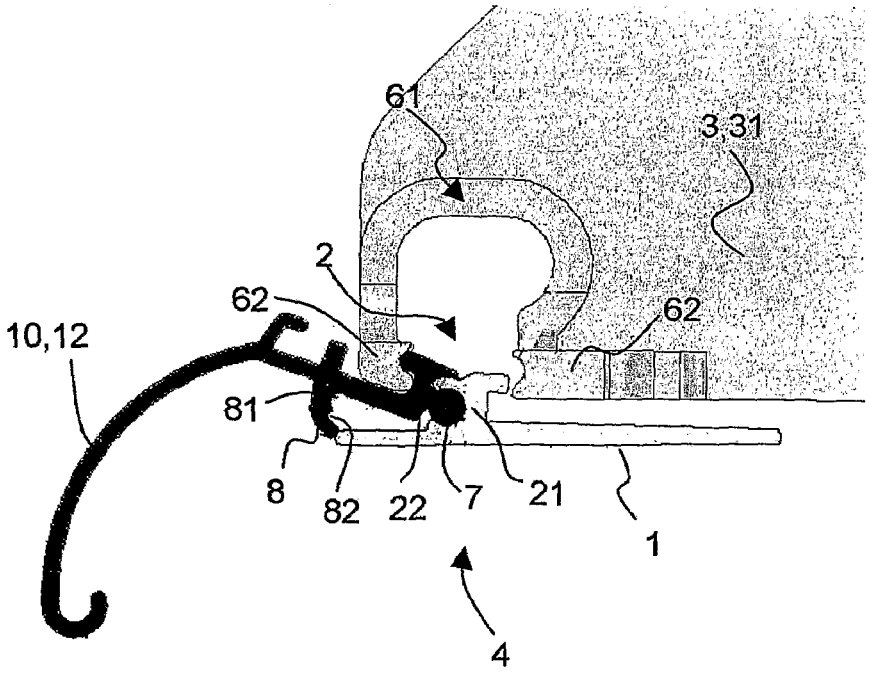
FIG. 4 is a cross-sectional view of the device as illustrated on FIG. 3, the clamping means in a released position.
Figure 5:
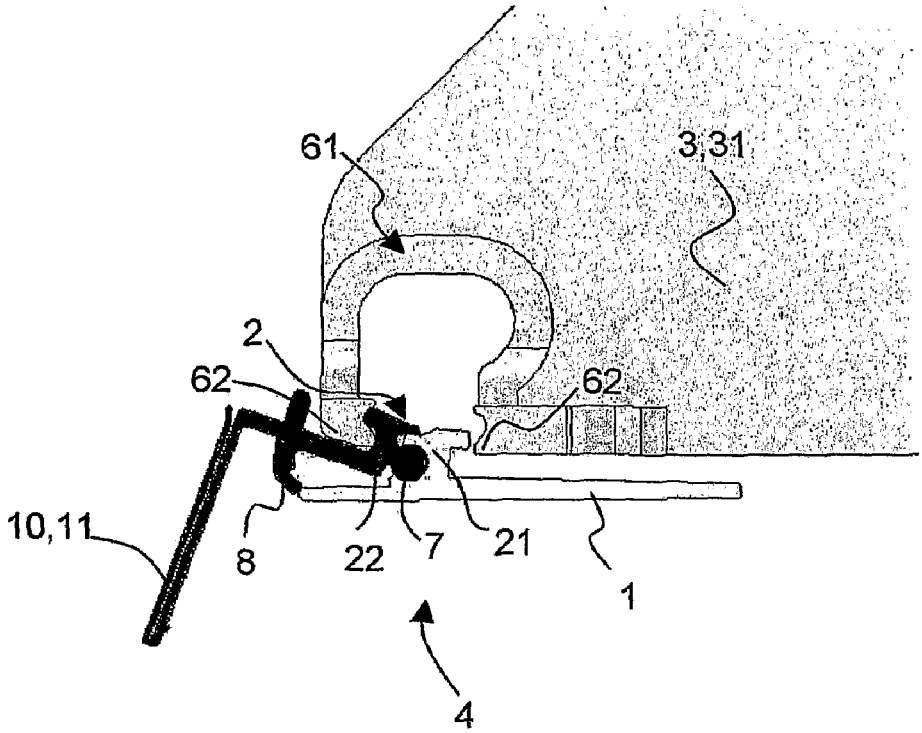
FIG. 5 is a sectional view of the device for the distribution of at least one presentation accessory according to a second embodiment.

Thus, advantageously, raising the profile 10, as illustrated on FIGS. 4 and 5, enables reduction of the distance from the horizontal wing of the T-shaped rail. Conversely, when the second profile 10 is lowered, the distance from said horizontal wing of the T-shaped rail is conversely increased.

Figure 9:
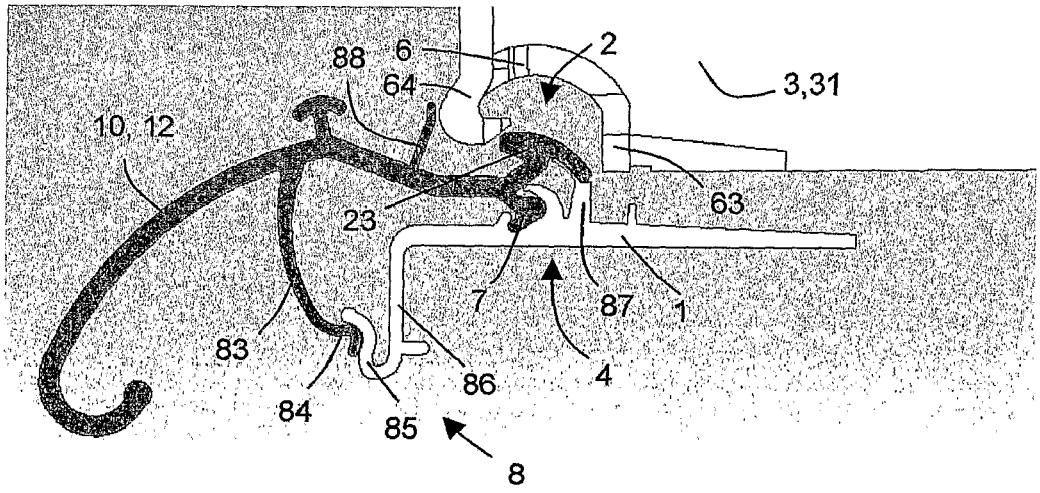
FIGS. 9 to 11 illustrate side schematic views of a display surface fitted with a device for the distribution of at least one presentation accessory according to a second embodiment.
Figure 10:
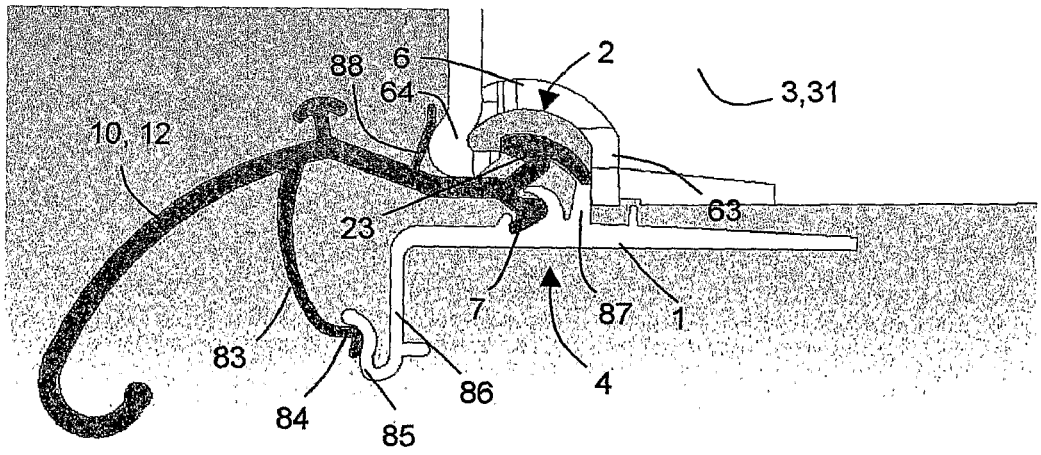
Figure 11:
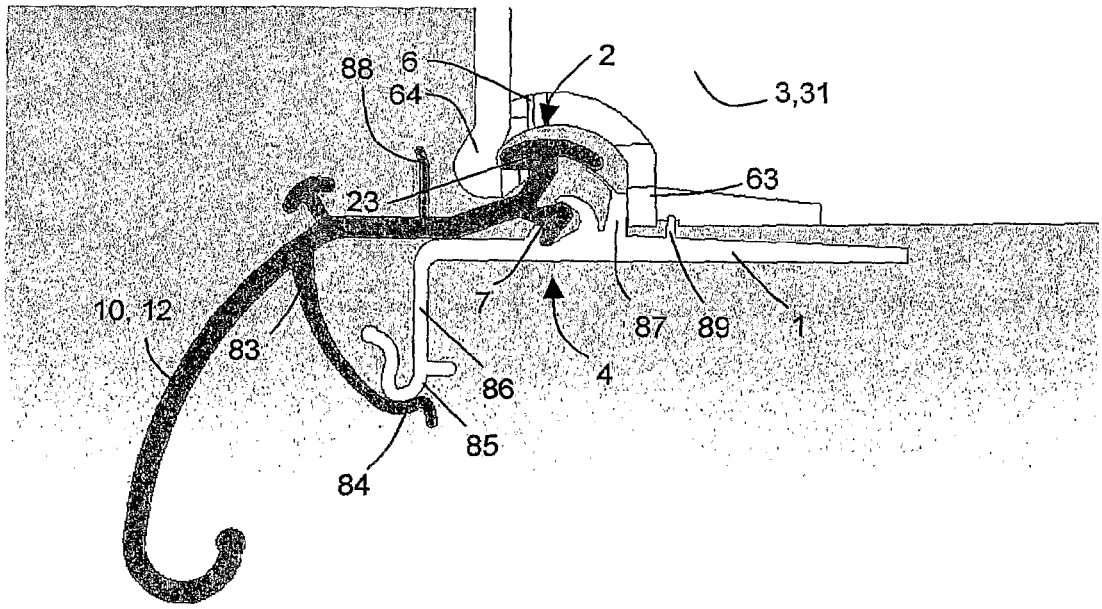

According to an embodiment illustrated in FIGS. 9 to 11, said at least one presentation accessory 3 exhibits catching means 6 consisting of a recess intended for accommodating the first guiding means 2. Said recess forms at least one front groove 64 and a rear stop 63.

Said at least one base profile 1 is hinged to a second profile 10 with a lever function, at a hinge 7, defining the first guiding means 2. The clamping means 4 is formed of a hook 23 of said second profile 10 capable of engaging into said front groove 64 in the locking position of said clamping means 4, and a protrusion 87 of the base profile 1 intended for cooperating with said rear stop 63.

Said second profile 10 may exhibit, moreover, a resilient blade cooperating with the front of the presentation accessory for urging the end of the hook 23 into the groove 64, when placing the accessory.

The distal end of the protrusion 87 may be fitted with an elastic thin strip whereof the free end is forced to slide at a lower zone of a wing of the hook 23. This thin strip forms a partition, in particular a tight partition, to protect the inside of the hinge of from dirt and dust.

Said at least base profile 1 may exhibit snapping means 8 to lock the second profile 10 in a locking position of the clamping means 4. As illustrated on FIG. 4, the snapping means 8 consist of at least one notch 81 capable of cooperating with the front ridge of the base profile 1 to lock the second profile 10 in said locking position.

Advantageously, the snapping means 8 may exhibit a second notch 82 enabling the second profile 10 to hold an intermediate position, allowing said presentation accessories 3 to slide along the axis 20 of the guiding means 2, without providing for easy disengagement thereof.

According to another embodiment illustrated on FIG. 11, the base profile 1 forms a front edge 86 intended for covering the front rim of a shelf. The snapping means 8 are then formed of an elastic finger 83 protruding downwards of the second profile 10, capable of cooperating elastically with the lower end 85 of the front edge 86 of the base profile 1.

The lower end 85 of said front edge 86 exhibits an S-shaped section to form two stable locking positions as illustrated in particular on FIGS. 9 and 11.

As illustrated on FIG. 9, the clamping means 4 are locked in said first, so-called loose position. As illustrated on FIG. 11, the clamping means 4 are locked in said second, so-called locking position.

Advantageously, the internal space formed between the elastic finger 83, the second profile 10 and the base profile 1 remains always closed so as not to provide a dust catcher.

The second profile 10 can be a tag supporting profile 11, or still a mother profile 12 for fastening tag holders 14.

As illustrated on FIG. 5, the second profile 10 extends forward and beneath the base profile 1. The second profile 10 then enables replacement of the tag supporting profiled sticks of the state of the previous art which are fixed to the front edge of a shelf. As illustrated on FIG. 5, the second profile 10 is a tag supporting profile 11 which exhibits a pocket for the reception of said tags.

Figure 7:
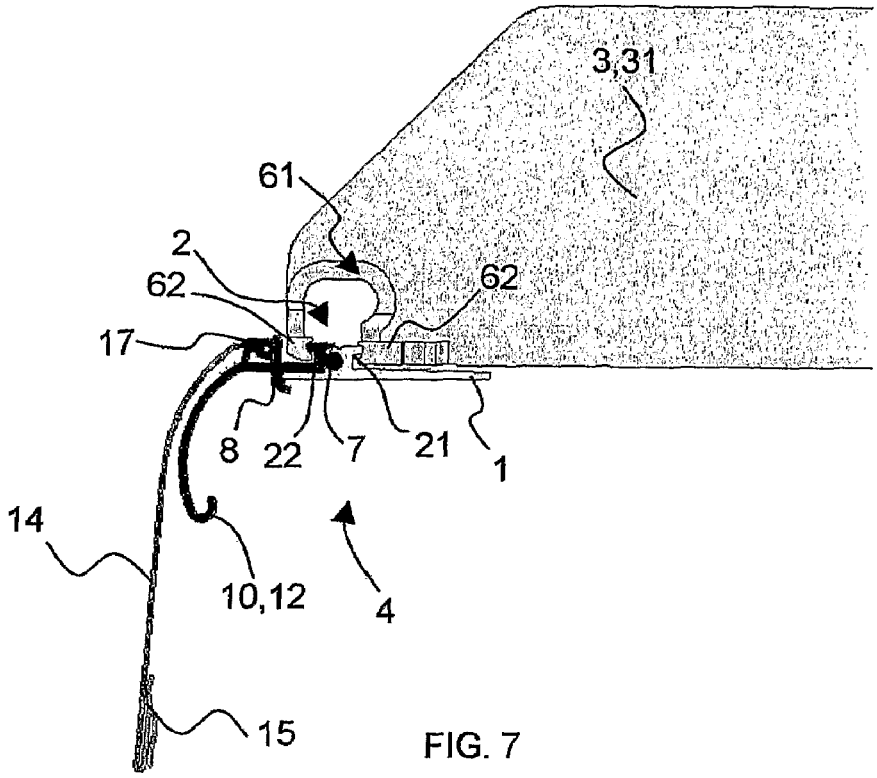
FIG. 7 is a side and detailed sectional view of a device as illustrated on FIG. 2, fitted with a tag support.
Figure 8:
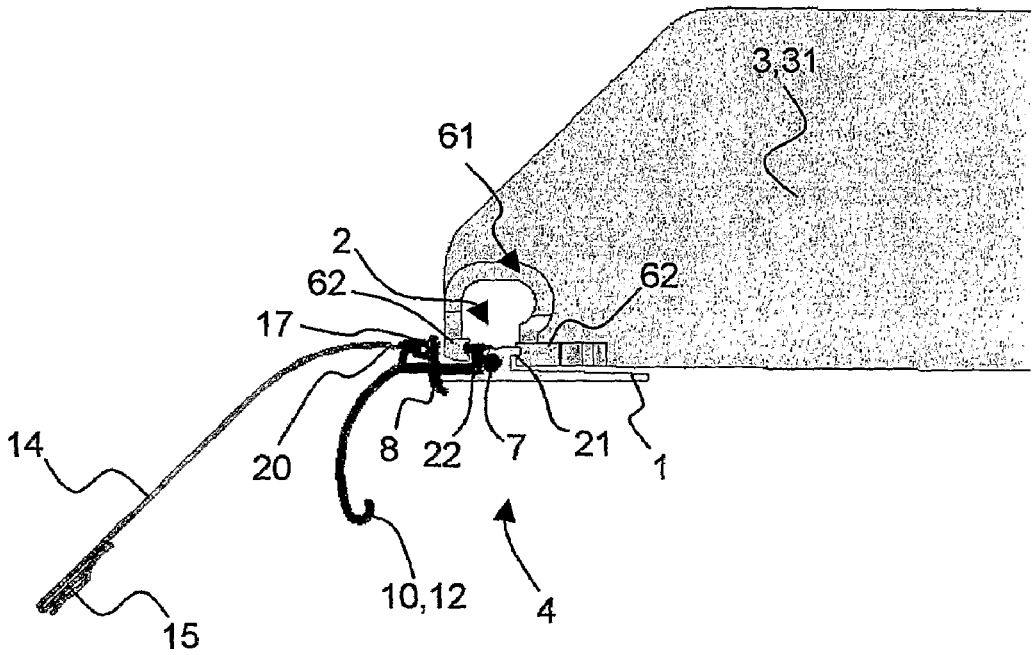
FIG. 8 is a side and detailed sectional view of the device as illustrated on FIG. 7, the tag support in a raised position.

The second profile 10 may be a mother profile 12 for fastening tag holders 14. As illustrated in FIGS. 7 and 8 or still 9, in particular, the mother profile 12 extends advantageously ahead of the base profiled stick 1 beneath the latter. The mother profile 12 exhibits on its upper portion snapping means for fastening tag holders.

The tag holders 14 are capable of being fastened to said snapping means at an upper head 17. They extend downwards beneath said mother profile 12 and exhibit, at the lower section thereof, a pocket 15 for the reception of at least one tag. Advantageously, the latter may be tilted upwards at a joint 20 situated at the fastening head 17. This joint may be provided as known during the extrusion at a narrowed section of flexible material 20.

Advantageously, the device and, in particular, the profiles are realized, during extrusion in a plastic material by extrusion.

The previous description illustrates, with the appending drawings, embodiments of a device for the distribution of a presentation accessory in case when the latter is a partition wall.

Obviously, the presentation accessories may take on other forms, and in particular that of an article display rack. In the latter case, the article display rack may exhibit a stud and a jaw situated on the front portion of a running track of a back rest.

Naturally, other embodiments, understandable to the man of the art, could have been contemplated without departing from the framework of this application as defined by the claims below.

We claim:

1. An apparatus for use on a display surface for the presentation of goods, the apparatus comprising:

at least one display accessory having a partition wall suitable for dividing the display surface, the display accessory having a catch defined by a recess formed thereon, said recess having at least one front groove and a rear stop;

a first guide member suitable for fastening to a proximal portion of the display surface, said first guide member extending longitudinally, said first guide member being cooperative with said catch;

a first profile suitable for fastening to the proximal portion of the display surface, said first profile having a T-shaped rail;

a second profile joined by a hinge to said first profile, said second profile having a T-shaped rail, said second profile being movable with respect to said hinge to a first position and a second position, said first position being an upper position allowing a displacement of the display accessory along a longitudinal axis of the display surface, said second position being a lower position in which the display accessory is locked so as to solidly secure the display accessory to said first guide member, said second profile being a tag support profile suitable for removably receiving a tag holder, said second profile having a hook suitable for engaging the front groove of the display accessory when in said second position, said first profile having a protrusion cooperative with said rear stop of the display accessory.

2. The apparatus of claim 1, said protrusion of said first profile having a distal end fitted with an elastic thin strip having a free end, said hook of said second profile having a wing with a lower zone formed thereon, said free end of said elastic thin strip being slidable at said lower zone of said wing of said hook.

3. The apparatus of claim 1, said first profile and said second profile having a snapping means thereon for locking said second profile in said second position.

4. The apparatus of claim 3, said first profile having a front edge, said snapping means comprising an elastic finger protruding from said second profile so as to elastically cooperate with a lower end of said front edge.

5. The apparatus of claim 4, said lower end of said front edge having an S-shaped section so as to form a pair of locking positions.

6. The apparatus of claim 1, the display surface having a distal surface, the apparatus further comprising:

a second guide member suitable for affixing to the distal surface, said second guide member cooperative with the display accessory.

* * * * *